US006136490A

United States Patent [19]

Ogawa et al.

[11] Patent Number: 6,136,490

[45] **Date of Patent: *Oct. 24, 2000**

[54] POLYMERIZED TONER

[75] Inventors: Tokudai Ogawa; Jun Sakai, both of Kawasaki; Jun Hasegawa, Tokyo, all of Japan

[73] Assignee: Nippon Zeon Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/985,215

[22] Filed: Dec. 4, 1997

[30] Foreign Application Priority Data

Dec. 5, 1996 [JP] Japan ..... 8-340678

[51] Int. Cl.[7] ..... G03G 9/093

[52] U.S. Cl. ..... 430/109; 430/137

[58] Field of Search ..... 430/109, 137

[56] References Cited

U.S. PATENT DOCUMENTS

| | | | |
|---|---|---|---|
| 4,077,804 | 3/1978 | Vanzo . | |
| 4,804,610 | 2/1989 | Mori et al. | 430/137 |
| 5,213,934 | 5/1993 | Sacripante et al. | 430/109 |
| 5,336,581 | 8/1994 | Inaba et al. | 430/110 |
| 5,958,640 | 9/1999 | Hasegawa et al. | 430/109 |

FOREIGN PATENT DOCUMENTS

| | | | |
|---|---|---|---|
| 9-258472 | 10/1997 | Japan | G03G 9/08 |

OTHER PUBLICATIONS

English Translation of JP9–258,472, Ishiyama et al., Oct. 3, 1997.

Derwent WPI Acc No. 82–32311/198216; Abstract of JP 57–045558A published Mar. 15, 1982.

Derwent WPI Acc No. 86–186166/198629; Abstract of JP 61–118758A published Jun. 6, 1986.

Derwent WPI Acc No. 91–212627/199129; Abstract of JP 3–136065A published Jun. 10, 1991.

Derwent WPI Acc No. 92–256911/199231; Abstract of JP 59–061843A published Jul. 8, 1882.

*Primary Examiner*—Mark Chapman

*Attorney, Agent, or Firm*—Armstrong, Westerman, Hattori, McLeland & Naughton

[57] ABSTRACT

A monomer for a shell or a mixture of at least two monomers for a shell was suspension polymerized in the presence of core particles and a polymerization initiator to obtain polymer particles, wherein said core particles are formed of a polymer obtained by polymerization of a monomer for a core or a mixture of at least two monomers for a core and containing a colorant, wherein said monomer for a shell or mixture of monomers for a shell is one which gives upon polymerization a polymer having a glass transition temperature higher than that of the polymer forming the core particle, and wherein said polymerization initiator is represented by the following formula 1:

(1)

wherein $X^1$, $X^2$, $X^3$ and $X^4$ independently represent oxygen atom, sulfur atom, >NR (wherein R is hydrogen atom, alkyl group, or group); $R^1$, $R^2$, $R^3$, $R^4$, $R^5$ and $R^6$ independently represent alkyl group, aryl group, or alkyl or aryl group having at least one substituent which is —OR, —OH, —NHR, or —$NR_2$(wherein R is alkyl group or aryl group), and n and m independently represent an integer of 1 to 10. An outer additive was applied on the polymer particle to obtain a polymerized toner. This polymerized toner has low fixing temperature, excellent overhead projector transparency, good shelf stability, and exhibiting a less pronounced reduction in electric charge under conditions of high humidity and high temperature.

22 Claims, 1 Drawing Sheet

POLYMERIZED TONER

FIELD OF THE INVENTION

This invention relates to a polymerized toner and an apparatus for forming a visible image, and more particularly to a polymerized toner for development of an electrostatic latent image obtained by an electrophotographic method or an electrostatic recording method and an apparatus for forming a visible image of the toner.

DESCRIPTION OF THE RELATED ART

An electrostatic latent image formed with a visible image forming apparatus, such as an electrophotographic apparatus or an electrostatic recorder, has been developed with a toner to obtain a visible image on photosensitive material, the visible image has been transcribed onto a transcription sheet such as a paper or a resin sheet for an overhead projector and fixed on the sheet by heating, pressing, treating with a solvent vapor or so on.

Continued improvement in the accuracy of the image formed with a visible image forming apparatus has been achieved year after year. A pulverized toner, which is obtained by adding colorant and other material into melted resin, solidifying the resin, pulverizing to granulate the resin, and classifying the resin particle was mainly used. Recently, attention has been directed to a polymerized toner, since it is easy to control the particle size of the toner and unnecessary to classify the resin particle in the method for producing the polymerized toner.

In an electrophotographic apparatus, savings in electric power cost and higher speed duplicating or higher speed printing are demanded. A step which consumes electric power in largest quantity in electrophotography is the fixing step, in which the visible image on the photosensitive material transcribed onto a transcription sheet such as paper is fixed on the sheet. A heating roll at a temperature of not less than 150 degrees centigrade is used to fix the toner on the sheet. Electric power is used as energy source for the heating roll. To achieve energy saving, reducing the temperature of the heating roll is required. If the fixing can be obtained at low temperature, higher speed printing and so on can be accommodated. It is necessary to lower the fixing temperature of the toner for this purpose. The glass transition temperature of the polymer constituting the toner may be lowered to obtain the toner having the low fixing temperature. However, the toner having a low glass transition temperature aggregates to form cohesion lumps as the toner is kept in the toner box of the electrophotographic apparatus or the toner casing and has poor shelf stability.

Otherwise, in color duplicating or color printing by electrophotography, obtaining a clear image is demanded. Especially, since the use of a color image on the overhead projection film or sheet for presentation in some meetings increases, a good transparency of the image formed on an overhead projector film is demanded. It is a necessary condition that the toner is fused uniformly on the overhead projector sheet or film in order to obtain sufficient overhead projector transparency. Designing a toner having lower fusing viscosity than that of former toner is under the approximate fixing temperature of a toner is necessary. As the method for reducing the fusing viscosity of the toner, there were mentioned that the molecular weight of a binding resin for toner is lowered, the glass transition temperature of the resin is lowered, or so on. However in case of any of the above methods, the obtained toner has poor shelf stability, and tends to aggregate easily.

A polymerized toner obtained by suspension-polymerizing a macro-monomer and polymerizable monomer in the presence of surfactant and calcium phosphate was suggested (see Japanese laid-open patent application Tokukaihei 3-136,065). In this toner, the macro-monomer as a monomer unit of the polymer molecular chain is included, and many branched chains are formed by the molecular chain of the macro-monomer. Therefore, the anti-offset property is enhanced by entanglement of the branched chains with one another, that is, physical cross-linking, as the apparent molecular weight of polymer become higher. And the fixability is improved, since the physical cross-linking of the macro-monomer is different from a chemical cross-linking obtained by crosslinkable monomer such as divinylbenzene and so on, and since the polymer has a loose cross-linking structure which gives way readily. However, this toner forms cohesion lumps and does not have sufficient shelf stability. Under conditions of high temperature and high humidity, the amount of charge of the toner is reduced remarkably.

Thus, the above former method for enhancement of overhead projector transparency or lowering the fixing temperature of toner leads to poor shelf stability. An opposite interrelation exists between the overhead projector transparency or the fixing temperature of the toner and shelf stability. As a method for resolution of this opposite interrelation, an encapsulated toner, obtained by applying a polymer shell having a high glass transition temperature to cover toner particles in order to enhance shelf stability, was suggested.

As the process for producing the encapsulated toner, Japanese laid-open patent application Tokukaishou 57-45, 558 taught a process of producing toner for electrophotography comprising: dispersing core particles formed by polymerization in 1 to 40 weight % of an aqueous solution of latex, adding a water-soluble inorganic salt, and forming a covering layer of minute particles which are obtained by emulsion polymerization on the surface of the core particles. The variability of the charge property due to ambient conditions was enlarged, especially the amount of charge on the toner was reduced under high temperature and high humidity, by influence of a surfactant or an inorganic salt present on the minute particle.

Japanese laid-open patent application Tokukaishou 61-118,758, Japanese laid-open patent application Tokukaishou 59-61,843 and others disclosed the method of growing core particles comprised of a suspension polymerizing composition containing a vinyl monomer, a colorant, and an azo bis polymerization initiator to obtain a core particle, and polymerizing a hydrophilic monomer giving a polymer having a glass transition temperature higher than that of the polymer forming the core particle with an oil-soluble polymerization initiator, such as benzoyl peroxide, in the presence of the core particle to form a shell over the core particle. In this method, a vinyl monomer which forms a shell-forming polymer is absorbed into the core particle, and is polymerized in the core particle. Therefore, this method does not reliably form a distinct core-shell structure, to improve sufficiently the shelf stability of the toner. The thickness of the shell has to be increased in order to obtain a distinctive core-shell structure, and to improve shelf stability.

U.S. Pat. No. 4,077,804 disclosed a method for growing a core particle comprised of a suspension polymerizing composition containing a vinyl monomer, a colorant, and a polymerization initiator to obtain a core particle, polymerizing a hydrophilic vinyl monomer which forms a polymer having a glass transition temperature higher than that of the polymer forming the core particle with a water-soluble polymerization initiator, such as potassium persulfate, in the presence of the core particle to form a shell over the core particle. Since the charge of the toner obtained by this method was lowered under conditions of high humidity, appearance of a fog or reduction of printing density occurred.

SUMMARY OF THE INVENTION

An object of the present invention is to provide a polymerized toner having a lower fixing temperature, a good OHP transparency, an excellent shelf stability, and a lesser reduction in charge under high humidity conditions.

The present inventors made a study in order to achieve the above object and found that the object can be accomplished by providing a polymerized toner comprising a polymer particle obtained by polymerizing a monomer for a shell, which monomer forms a polymer having a glass transition temperature higher than that of the polymer forming a core particle, with a specific polymerization initiator in the presence of the core particle which includes a colorant.

In one aspect of the present invention, there is provided a polymerized toner comprising polymer particles obtained by suspension polymerizing a monomer for a shell or a mixture of monomers for a shell, which monomer forms a polymer having a glass transition temperature higher than that of a polymer forming a core particle, in the presence of the core particles which includes a colorant, and with a polymerization initiator represented by the following formula 1:

(1)

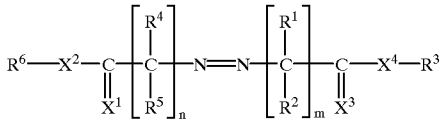

wherein $X^1$, $X^2$, $X^3$ and $X^4$ independently represent oxygen atom, sulfur atom, >NR (wherein R is hydrogen atom, alkyl group, or aryl group); $R^1$, $R^2$, $R^3$, $R^4$, $R^5$ and $R^6$ independently represent alkyl group, aryl group, or alkyl or aryl group having at least one substituent which is —OR, —OH, —NHR, or —$NR_2$ (wherein R is alkyl group or aryl group), and n and m independently represent an integer of 1 to 10.

In a preferred embodiment of the polymerized toner, the core particle is obtained by suspension polymerizing a monomer for a core which forms a polymer having a glass transition temperature of not more than 70 degrees centigrade and a macro-monomer.

In another preferred embodiment of the polymerized toner, the core particle is obtained by suspension polymerizing a monomer for a core, a macro-monomer, and a crosslinkable monomer.

In another preferred embodiment of the polymerized toner, the suspension polymerization is carried out in the presence of a dispersant comprising a colloid of a water-insoluble metal hydroxide.

In another preferred embodiment of the polymerized toner, the dispersant comprises a colloid of a water-insoluble metal hydroxide having a particle size at 50 percent of the cumulative number distribution of particle size (D50) of not more than 0.5 micrometer, and having a particle size at 90 percent of the cumulative number distribution of particle size (D90) of not more than 1 micrometer.

In another preferred embodiment of the polymerized toner, the dispersant comprises a colloid of a water-insoluble metal hydroxide, obtained by bringing to a value of not less than 7 the hydrogen ion exponent (pH) of an aqueous solution of a water-soluble multivalent metal compound.

In another preferred embodiment of the polymerized toner, the dispersant comprises a colloid of a water-insoluble metal hydroxide, obtained by reacting a water-soluble multivalent metal compound with an alkali metal hydroxide in a water phase.

In another preferred embodiment of the polymerized toner, the monomer for the core is selected from the group consisting of styrene, acrylic acid, methacrylic acid, and a derivative thereof.

In another preferred embodiment of the polymerized toner, the monomer for the core is a mixture of styrene and n-butyl acrylate, a mixture of styrene and 2-ethyl hexyl acrylate, or a mixture of styrene, n-butyl acrylate and 2-ethyl hexyl acrylate.

In another preferred embodiment of the polymerized toner, the macro-monomer has an acrylyl group or a methacrylyl group at the end of the molecular chain.

In another preferred embodiment of the polymerized toner, the macro-monomer is a polymer or a copolymer of methacrylate or acrylate.

In another preferred embodiment of the polymerized toner, the suspension polymerization is carried out after making a suspension of liquid droplets, having a number average particle size smaller than that of the core particle, of the monomer for the shell in water.

In another preferred embodiment of the polymerized toner, the monomer for the shell has a water solubility of not less than 0.1 weight percent at 20 degrees centigrade.

In another preferred embodiment of the polymerized toner, the suspension polymerization is carried out by adding the monomer for the shell having a water solubility of less than 0.1 weight percent at 20 degrees centigrade and an organic solvent.

In another preferred embodiment of the polymerized toner, the suspension polymerization of the monomer for the shell is carried out in the presence of an electric charge control agent.

In another preferred embodiment of the polymerized toner, the core particle is obtained by suspension polymerizing the monomer for the core, a macro-monomer, and a crosslinkable monomer as occasion demands, with an oil-soluble radical polymerization initiator.

In another preferred embodiment of the polymerized toner, the core particle is obtained by a process, which comprises the steps of:

pouring a polymerizable monomer composition containing a monomer for the core and a colorant other than an oil-soluble polymerization initiator into an aqueous dispersion medium containing the dispersant, adding an oil-soluble polymerization initiator to the polymerizable monomer composition while stirring the composition to form primary droplets thereof, thereby bringing the droplets of the polymerizable monomer composition into contact with droplets of the oil-soluble polymerization initiator to form droplets of a polymerizable monomer composition containing the oil-soluble polymerization initiator;

further conducting the stirring to form secondary droplets having desired droplets sizes; and then conducting suspension polymerization of the polymerizable monomer composition.

In another preferred embodiment of the polymerized toner, the oil-soluble radical polymerization initiator is an organic peroxide having a molecular weight if not more than 250 and a temperature of a half-life period of 10 hours of 60 to 80 degrees centigrade.

In another preferred embodiment of the polymerized toner, the core particle is obtained by suspension polymerizing the monomer for the core, a macro-monomer, and a crosslinkable monomer as occasion demands, in the presence of a colorant.

In another preferred embodiment of the polymerized toner, the polymerization initiator is represented the above formula 1: wherein $X^1$ and $X^3$ are oxygen atom; $X^2$ and $X^4$ independently are >NR (wherein R is hydrogen atom, alkyl group or aryl group); $R^1$, $R^2$, $R^4$, and $R^5$ are methyl group; $R^3$ and $R^6$ independently are alkyl group having at least one —OH substituent; and n and m independently are an integer of 1 to 3.

In another preferred embodiment of the polymerized toner, the polymerization initiator represented by the formula 1 is 2,2'-azobis(2-methyl-N-(1,1-bis(hydroxymethyl)-2-hydroxyethyl)propionamide) or 2,2-azobis(2-methyl-N-(2-hydroxyethyl)-propionamide).

In another aspect of the present invention, there is provided a method of forming an image comprising the steps of: recording an electrostatic latent image on a photosensitive material, attaching the above polymerized toner on the photosensitive material to obtain a visible image, and transcribing the visible image onto a transcription sheet.

In another aspect of the present invention, there is provided an apparatus for forming an image comprising: a photosensitive material; means for charging the surface of the photosensitive material; means for recording an electrostatic latent image on the surface of the photosensitive material; means for storing the above polymerized toner; means for developing the electrostatic latent image on the surface of the photosensitive material with the toner to obtain a toner image; and means for transcribing the toner image from the surface of the photosensitive material onto a transcription sheet.

DETAILED DESCRIPTION OF THIS INVENTION

Figure 1:
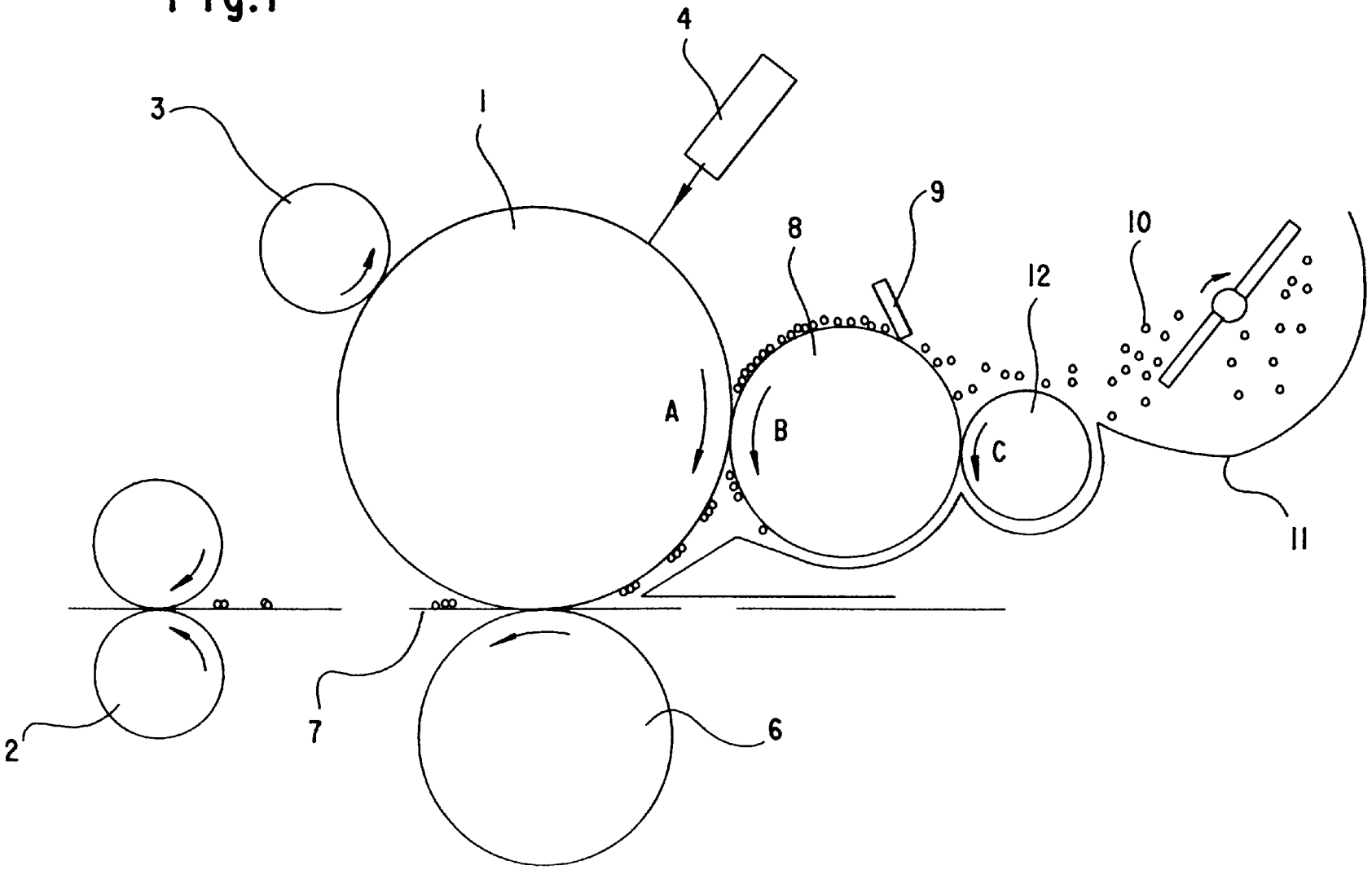
FIG. 1 illustrates an embodiment of an image forming apparatus of the present invention.

The polymerized toner of the present invention comprises polymer particles obtained by suspension polymerizing a monomer for a shell, which monomer forms a polymer having a glass transition temperature higher than that of a polymer forming the core particle, with a polymerization initiator represented by the formula 1.

The core particle used in this invention is a polymer particle which includes a colorant.

The core particle is generally a particle formed of a polymer, such as, polyester resin, methacrylate-styrene copolymer, acrylate-styrene copolymer and so forth, preferably methacrylate-styrene copolymer or acrylate-styrene copolymer.

The polymer forming the core particle is not limited by the process of manufacture, and is generally obtained by polymerizing a monomer for the core.

The monomer for the core is a monomer which forms a polymer having a glass transition temperature of not more than 80 degrees centigrade, preferably 10 to 70 degrees centigrade, more preferably 20 to 60 degrees centigrade. The term "monomer" as used herein means either one or a combination of monomers. If the glass transition temperature of the polymer obtained from the monomer for the core is more than 80 degrees centigrade, the fixing temperature is raised, and overhead projector transparency is reduced, and therefore the toner cannot be used reliably for high speed printing.

The glass transition temperature of the polymer is Tg as calculated from the nature of the monomer and the amount of monomer. If a monomer is used alone, the glass transition temperature of the homo-polymer obtained by polymerizing the monomer defines the glass transition temperature of the polymer in the present invention. For example, since the glass transition temperature of polystyrene is 100 degrees centigrade, it is stated that the monomer gives a polymer having a glass transition temperature of 100 degrees centigrade if styrene is used alone as a monomer. If the monomer is a combination of monomers and the formed polymer is a co-polymer, the glass transition temperature of the co-polymer is calculated from the nature of each monomer and the amount of each monomer. For example, since the calculated Tg of the co-polymer of 78% by weight of styrene and 22% by weight of n-butyl acrylate is 50 degrees centigrade, the "monomer" of styrene and n-butyl acrylate is considered to give a polymer having a glass transition temperature of 50 degrees centigrade.

Also, the definition of "a monomer which forms a polymer having a glass transition temperature of not more than 80 degrees centigrade" does not means that all of the monomers individually should give a polymer having a glass transition temperature of not more than 80 degrees centigrade. If a monomer is used alone, the homo-polymer obtained by polymerizing the monomer should have a glass transition temperature of not more than 80 degrees centigrade. If a "monomer" is a combination of monomers, the co-polymer obtained by polymerizing the monomer mixture should have a glass transition temperature of not more than 80 degrees centigrade, but the homo-polymer obtained by polymerizing each monomer in the monomer mixture may have a glass transition temperature of more than 80 degrees centigrade. For example, the homo-polymer of styrene has a glass transition temperature of 100 degrees centigrade. If a co-polymer having a glass transition temperature of not more than 80 degrees centigrade can be obtained by polymerizing a monomer giving a polymer having a low glass transition temperature with styrene, then styrene may be used as one of the monomers.

In the present invention, a vinyl monomer is generally used as a monomer for the core. The desired glass transition temperature of the polymer is regulated by using this vinyl monomer alone or in combination.

As the vinyl monomer used in the present invention, there can be mentioned styrene derivative monomers such as styrene, vinyltoluene, a —methyl styrene; derivatives of acrylic acid or methacrylic acid such as acrylic acid, methacrylic acid, methyl acrylate, ethyl acrylate, propyl acrylate, butyl acrylate, 2-ethylhexyl acrylate, dimethyl amino ethyl acrylate, methyl methacrylate, ethyl methacrylate, propyl methacrylate, butyl methacrylate, 2-ethylhexyl methacrylate, dimethyl amino ethyl methacrylate, acrylonitrile, methacrylonitrile, acrylamide, methacrylamide; ethylenically unsaturated mono-olefin such as ethylene, propylene, butylene; halogenated vinyl monomer such as vinyl chloride, vinylidene chloride, vinyl fluoride; vinyl ester such as vinyl acetate, vinyl propionate; vinyl ketone such as vinyl methyl ketone, methyl isopropenyl ketone; vinyl compounds containing nitrogen such as 2-vinyl pyridine, 4-vinyl pyridine, N-vinyl pyrrolidone; and so forth. These vinyl monomers can be used either alone or in combination. Of these vinyl monomers, styrene derivative monomers, or derivatives of acrylic acid or methacrylic acid can be preferably used as a monomer for the core.

A crosslinkable monomer is preferably used with the monomer for the core which is the vinyl monomer to enhance shelf stability. As the crosslinkable monomer, there can be mentioned aromatic divinyl compounds such as divinylbenzene, divinylnaphthalene, and derivatives thereof; diethylenically unsaturated carboxylates such as ethylene glycol di-methacrylate, di-ethylene glycol di-methacrylate; di-vinyl compounds such as N,N-divinyl aniline, di-vinyl ether; compounds having at least three vinyl groups and so on. These crosslinkable monomers can be used either alone or in combination. The amount of the crosslinkable monomer is usually in a range of 0.1 to 5 parts by weight, preferably 0.3 to 2 parts by weight, based on 100 parts by weight of the monomer for the core.

A macro-monomer used furthermore with the monomer for the core is preferable, since the balance of shelf stability and fixability is enhanced hereby. The macro-monomer is an oligomer or a polymer having polymerizable vinyl groups on the ends of the molecular chain and a number average molecular weight of 1,000 to 30,000. If the number average molecular weight is too small, the surface of the polymer particle become limp, and shelf stability is reduced. If the number average molecular weight is too large, solubility of the macro-monomer is reduced, and fixability and shelf stability are reduced. As the polymerizable vinyl group on the ends of the molecular chain of the macro-monomer, there can be mentioned acrylyl group, methacrylyl group and so on. Methacrylyl group is preferable in view of co-polymerizability.

It is preferable that the macro-monomer used in the present invention has a glass transition temperature higher than that of a polymer obtained by polymerizing the monomer for the core.

The required difference in glass transition temperature between the macro-monomer and the polymer obtained by polymerizing the monomer for the core depends on the macro-monomer and the monomer for the core. For example, if a monomer for the core gives a polymer having a glass transition temperature of 70 degrees centigrade, the macro-monomer should have a glass transition temperature of more than 70 degrees centigrade. For example, if a monomer for the core gives a polymer having a glass transition temperature of 20 degrees centigrade, the macro-monomer may have a glass transition temperature of 60 degrees centigrade. Incidentally, the glass transition temperature of a macro-monomer is a value obtained by measuring with a method such as DSC method.

As examples of the macro-monomer, there can be mentioned a polymer obtained by polymerizing a monomer, such as styrene, derivative of styrene, methacrylate, acrylate, acrylonitrile, methacrylonitrile and so forth, either alone or in combination; a macromonomer having a polysiloxane unit; a macro-monomer as disclosed in pages 4 to 7 of Japanese laid open patent application Tokukaihei 3-203746.

In these macro-monomers, a hydrophilic macro-monomer, especially a polymer obtained by polymerizing methacrylate or acrylate either alone or in combination is preferable for the present invention.

The amount of the macro-monomer is generally 0.01 to 10 percents by weight, preferably 0.03 to 5 percents by weight, more preferably 0.05 to 1 percent by weight, based on the monomer for the core. If the amount of the macro-monomer is too small, the balance between shelf stability and fixability is not enhanced. If the amount of the macro-monomer is too large, fixability is reduced.

As a method of polymerizing the monomer for the core and the macro-monomer and/or the crosslinkable monomer as occasion demands, there can be mentioned emulsion polymerization, suspension polymerization, deposition polymerization and so on, preferably suspension polymerization.

The suspension polymerization is generally carried out in an aqueous dispersion medium including a dispersant. Specifically, the vinyl monomer, macro-monomer and crosslinkable monomer as occasion demands, colorant and other additives are mixed, and dispersed with means such as a ball-mill to obtain a mixed liquid (hereinafter sometimes referred to a feed liquid). And then said feed liquid is charged into an aqueous dispersion medium containing a dispersant, dispersed with a mixing machine having high shearing stress to give minute liquid particles, radical polymerization initiator is added in the middle of the dispersing step and the feed liquid is suspension polymerized at 30 to 200 degrees centigrade.

In the production process of the core particle, the following process is preferable for purpose of uniform dispersion of the colorant in the core particle. A colorant and optionally additives (for example, a charge control agent) other than an oil-soluble polymerization initiator are added to a polymerizable monomer, and these components are stirred and mixed to prepare a polymerizable monomer composition comprising the individual components dissolved or dispersed uniformly therein. After the composition is poured into an aqueous dispersion medium containing a dispersing agent, the oil-soluble polymerization initiator is added to the aqueous dispersion medium with stirring. In the step, droplets of the polymerizable monomer composition are brought into contact with droplets of the oil-soluble polymerization initiator, so that both droplet components unite with each other, whereby droplets of a polymerizable monomer composition containing the oil-soluble polymerizable initiator are formed. The time the oil-soluble polymerization initiator is added to the aqueous dispersion medium must be after the polymerizable monomer composition is poured and in the course of forming droplets of the polymerizable monomer component. When the oil-soluble polymerization initiator is added after the polymerizable monomer composition is formed into fine droplets having desired droplet sizes in the aqueous dispersion medium, the oil-soluble polymerization initiator is difficult to uniformly mix with such droplets. The time the oil-soluble polymerization initiator is added is when the droplet size (volume average droplet size) of the primary droplets formed by the stirring after the pouring of the polymerizable monomer composition comes to generally 50–1,000 $\mu$m, preferably 100–500 $\mu$m though the time varies according to the intended particle size of the resulting toner. When the period of the time from the pouring of the polymerizable monomer composition to the addition of the oil-soluble polymerization initiator is long, the formation of the droplets has been completed, so that the polymerizable monomer composition is not uniformly mixed with the oil-soluble polymerization initiator, resulting in difficulty in making resin properties such as polymerization degree and crosslinking degree uniform at every polymer toner particle. Therefore, the time the oil-soluble polymerization initiator is added is not longer than generally 24 hours, preferably 12 hours, more preferably 3 hours after the pouring of the polymerizable monomer composition on a large scale such as plant, or not longer than generally 5 hours, preferably 3 hours, more preferably 1 hour on a small laboratory scale though it somewhat varies according to reaction scale and the intended particle size of the resulting toner. The temperature of the aqueous dispersion medium between the time the oil-soluble polymerization initiator is added and the subsequent formation of droplets (namely, before initiation of polymerization) is controlled within a range of generally 10–40° C., preferably 20–30° C. If the temperature is too high, a partial polymerization reaction is started in the system. If the temperature is too low on the other hand, the flowability of the system is reduced when droplets are formed by stirring, resulting in possibility that it may interfere with formation of the droplets. After the droplets of the polymerizable monomer composition are brought into contact with the droplets of the oil-soluble polymerization initiator to form droplets of a polymerization initiator, the stirring is further continued to form secondary droplets of a polymerizable monomer composition containing the oil-soluble polymerization initiator, the stirring is further continued to form secondary droplets having desired droplet sizes, and suspension polymerization of the polymerizable monomer composition is then conducted. In the step of forming the secondary droplets, the secondary droplets are finely divided to such an extent that in the subsequent suspension polymerization, a polymer toner having a volume average particle size of generally about 1–50 $\mu$m, preferably about 5–30 $\mu$m is formed. The time the secondary droplets are formed can be optionally set according to the kinds and added amounts of the polymerizable monomer, additives, polymerization initiator and the like, temperature upon the formation of the droplets, the kind of a machine used it the formation of the droplets, and desired droplet sizes. After the conversion of the polymerizable monomer composition into a polymer exceeds 90%, the polymerizable monomer for shell may be additionally added to continue the polymerization.

The dispersant used preferably in the present invention comprises a colloid of a water-insoluble metal compound. As the water-insoluble metal compound, there can be mentioned sulfate such as barium sulfate, calcium sulfate; carbonate such as barium carbonate, calcium carbonate, magnesium carbonate; phosphate such as calcium phosphate; metal oxide such as aluminium oxide, titanium oxide; metal hydroxide such as aluminium hydroxide, magnesium hydroxide, iron hydroxide; and the like. Among these dispersants, a dispersant comprising a colloid of a water-insoluble metal hydroxide, which can narrow down the distribution of polymer particle size, is preferable for enhancing the sharpness of pictures.

The dispersant comprising a colloid of a water-insoluble metal hydroxide is not limited by the manufacturing method thereof. The dispersant comprising a colloid of a water-insoluble metal hydroxide, obtained by bringing to a value of not less than 7 the hydrogen ion exponent (pH) of an aqueous solution of a water-soluble multivalent metal compound, especially a colloid of a water-insoluble metal hydroxide obtained by reacting a water-soluble multivalent metal compound with alkali metal hydroxide in a water phase, is preferable.

The colloid of a water-insoluble metal compound used in the present invention which has a particle size at 50 percent of the cumulative number distribution of particle size (D50) of not more than 0.5 micrometer and a particle size at 90 percent of the cumulative number distribution of particle size (D90) of not more than 1 micrometer is preferable. If the colloid size is too large, the stability of the suspension polymerization declines, and the shelf stability of the toner is reduced.

The amount of the dispersant is generally 0.1 to 20 parts by weight based on 100 parts by weight of the monomer for the core. If the amount of the dispersant is less than 0.1 part by weight, it is difficult to obtain a good polymerization stability. If the amount of the dispersant is more than 20 parts by weight, the viscosity of the aqueous dispersion medium becomes large, and the distribution of toner particle size becomes undesirably wider.

In the present invention, as occasion demands, a dispersant comprising a water-soluble polymer can be used. As the water-soluble polymer, there can be mentioned polyvinylalcohol, methyl cellulose, gelatin and the like. In the present invention, though a surfactant is unnecessary, it can be used in order to carry out a stable suspension polymerization unless the variability of the charge property with ambient conditions is enlarged.

As the radical polymerization initiator used to obtain the core particle, there can be mentioned persulfates such as ammonium persulfate, potassium persulfate; azo compounds such as 4,4-azobis-(4-cyanovaleric acid), 2,2-azobis-(2-amino di-propane) di-hydrochloride, 2,2-azobis-2-methyl-N-1,1-bis(hydroxy methyl)-2-(hydroxy ethyl propionamide, 2,2'-azobis-(2,4-dimethylvalrelonitrile), 2,2'-azobis-(1-cycloiso-butylonitrile), 1,1'-azobis-(1-cyclohexancarbonitrile); peroxides such as methyl ethyl peroxide, di-t-butyl peroxide, acetyl peroxide, dicumyl peroxide, lauroyl peroxide, benzoyl peroxide, t-butylperoxy-2-ethylhexanoate, di-iso-propylperoxy-dicarbonate, di-t-butylperoxy-isophthalate; and the like. Also, there can be mentioned a redox initiator consisting of a combination of the above polymerization initiator with a reducing agent. In these initiators, an oil-soluble radical polymerization initiator, especially an oil-soluble polymerization initiator selected from an organic peroxide having a molecular weight of not more than 250 and a temperature of a half-life period of 10 hours that is 60 to 80 degrees centigrade, preferably 65 to 80 degrees centigrade, more especially t-butylperoxy-2-ethylhexanoate, is preferable, because little odor and little environmental disruption due to the presence volatile matter are associated with such an initiator.

The amount of the polymerization initiator used for the core particle is generally 0.01 to 3 percent by weight based on the aqueous dispersion medium. With an amount less than 0.01 percent by weight, the polymerization rate become slower. With an amount greater than 3 percent by weight, the molecular weight is undesirably reduced.

As the colorant included in the core particle, there can be mentioned a dye or pigment such as carbon black, titan white, nigrosine base, aniline blue, chaico oil blue, chrome yellow, ultra marine blue, orient oil red, phthalocyanine blue, malachite green; magnetic particles such as cobalt, nickel, iron sesquioxide, triiron tetraoxide, manganese iron oxide, zinc iron oxide, nickel iron oxide.

As a colorant for a magnetic color toner, there can be mentioned C. I. Direct red 1, C. I. Direct red 4, C. I. Acid red 1, C. I. Basic red 1, C. I. Mordant red 30, C. I. Direct blue 1, C. I. Direct blue 2, C. I. Acid blue 9, C. I. Acid blue 15, C. I. Basic blue 3, C. I. Basic blue 5, C. I. Mordant blue 7, C. I. Direct green 6, C. I. Basic green 4, C. I. Basic green 6 and the like. As a pigment, there can be mentioned chrome yellow, cadmium yellow, mineral first yellow, navel yellow, naphtol yellow S, hanseatic yellow G, permanent yellow NCG, turtlazin lake, chrome orange, molybdate orange, permanent orange GTR, pyrazoline orange, benzidine orange G, cadmium red, permanent red 4R, watching red calcium salt, eosin lake, brilliant carmine 3B, manganate violet, first violet B, methyl violet lake, Prussian blue, cobalt blue, alkali blue lake, victoria blue lake, phthalocyanine blue, first sky blue, indanthrene blue BC, chrome green, chrome oxide, pigment green B, malachite green lake, final yellow green G.

As a magenta color pigment for a full color toner, there can be mentioned C. I. Pigment red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, and 209; C. I. Pigment violet 19; C. I. Vat red 1, 2, 10, 13, 15, 23, 29, and 35. As a magenta dye, there can be mentioned an oil-soluble dye such as C. I. Solvent red 1, 3, 8, 23, 24, 25, 27, 30, 49, 81, 82, 83, 84, 100, 109, and 121; C. I. Disperse red 9; C. I. Solvent violet 8, 13, 14, 21, and 27; C. I. Disperse violet 1; a basic dye such as C. I. Basic red 1, 2, 9, 12, 13, 14, 15, 17, 18, 22, 23, 24, 27, 29, 32, 34, 35, 36, 37, 38, 39, and 40; C. I. Basic violet 1, 3, 7, 10, 14, 15, 21, 25, 26, 27 and 28.

As a cyan color pigment for a full color toner, there can be mentioned C. I. Pigment blue 2, 3, 15, 16, and 17; vat blue 6; C. I. Acid blue 45; a copper phthalocyanine dye substituted with 1 to 5 of phthalimide methyl groups into the phthalocyanine structure and the like.

As a yellow color pigment for a full color toner, there can be mentioned C. I. Pigment yellow 1, 2, 3, 4, 5, 6, 7, 10, 11, 12, 13, 14, 15, 16, 17, 23, 65, 73, 83, and 138; C. I. Vat yellow 1, 3, and 20.

The amount of these pigment or dye, based on 100 parts by weight of a polymer forming a core particle, is generally 0.1 to 20 parts by weight, preferably 1 to 10 parts by weight. The amount of a magnetic particle, based on 100 parts by weight of a polymer forming a core particle, is generally 1 to 100 parts by weight, preferably 5 to 50 parts by weight.

In the present invention, furthermore, as occasion demands, additives such as a molecular weight control agent, a surface lubricant and other additives mixed with the monomer can be charged into the dispersion medium.

As the molecular weight control agent, there can be mentioned mercaptan such as t-dodecylmercaptan, n-dodecylmercaptan, n-octylmercaptan; halogenated hydrocarbon such as carbon tetra-chloride, carbon tetra-bromide. These molecular weight control agents can be charged before or under polymerization. The amount of the molecular weight control agent, based on 100 parts by weight of the monomer, is generally 0.01 to 10 parts by weight, preferably 0.1 to 5 parts by weight.

As the surface lubricant, there can be mentioned a low molecular weight polyolefin such as a low molecular weight polyethylene, a low molecular weight polypropylene, a low molecular weight polybutylene, paraffin wax.

The amount of the surface lubricant, based on 100 parts by weight of the monomer, is generally 0.1 to 40 parts by weight, preferably 1 to 20 parts by weight.

Furthermore, for purpose of uniform dispersion of the colorant in the core particle, a lubricant such as oleic acid and stearic acid; a dispersion assistant such as silane coupling agent and titanium coupling agent; and the like can be used. These lubricant or dispersion assistants, based on the weight of the colorant, are generally used in 1/1000 to 1/1 weight proportion.

The conversion rate of the suspension polymerization for obtaining the core particle used in the present invention is generally not less than 80 percent, preferably not less than 85 percent, more preferably not less than 90 percent. In case of less than 80 percent, the disparity of glass transition temperature between the core and the shell is reduced and shelf stability tend to be reduced, since the monomer for the core remains in large quantityl, and a co-polymer of the monomer for the core and the monomer for the shell covers the surface of the core particle after the monomer for the shell is added.

A polymer particle in the present invention is obtained by suspension polymerizing the monomer for the shell in the presence of the core particle.

In the present invention, a polymerization initiator used for suspension polymerization of the monomer for shell is represented by the formula 1.

As the polymerization initiator represented by the formula 1, there can be mentioned azoamidine compounds such as 2,2'-azobis(2-methyl-N-phenyl propionamidine) dihydrochloride, 2,2'-azobis(N-(4-chlorophenyl)-2-methyl propionamidine) dihydrochloride, 2,2'-azobis(N-(4-hydroxyphenyl)-2-methyl propionamindine) dihydrochloride, 2,2'-azobis(2-methyl-N-(phenyl methyl)-propionamidine) dihydrochloride, 2,2'-azobis(2-methyl-N-(2-propenyl) propionamidine) dihydrochloride, 2,2'-azobis (2-methyl propionamidine) dihydrochloride, 2,2'-azobis(N-(2-hydroxy ethyl)-2-methyl propionamidine) dihydrochloride; cyclo azoamidine compounds such as 2,2'-azobis(2-(2-imidazoline-2-yl)propane); azoamide compounds such as 2,2'-azobis(2-methyl-N-(1,1-bis (hydroxymethyl)-2-hydroxyethyl) propionamide), 2,2'-azobis(2-methyl-N-(1,1-bis(hydroxymethyl)ethyl) propionamide), 2,2'-azobis(2-methyl-N-(2-hydroxyethyl) propionamide), 2,2'-azobis(2-methyl propionamide) dihydrate. Among these polymerization initiators, azoamide compounds, especially 2,2'-azobis(2-methyl-N-(1,1-bis (hydroxymethyl)-2-hydroxyethyl) propionamide) or 2,2'-azobis(2-methyl-N-(2-hydroxyethyl) propionamide) are preferable in order to enlarge the static charge under high humidity. The amount of the polymerization initiator represented by the formula 1, based on the aqueous dispersion medium, is generally 0.001 to 2 percent by weight.

The monomer for the shell used in this invention is one giving a polymer having a glass transition temperature higher than that of a polymer obtained by polymerizing the monomer for the core.

As the monomer for the shell, there can be mentioned a monomer forming a polymer having a glass transition temperature of more than 70 degrees centigrade such as styrene, or methylmethacrylate. These monomers can be used either alone or in combination. If the polymer obtained by the monomer for the core has a glass transition temperature of far less than 70 degrees centigrade, the monomer for the shell may be one forming a polymer having a glass transition temperature of not more than 70 degrees centigrade. It is necessary to set the glass transition temperature of a shell polymer formed from the shell monomer to be higher than that of a core polymer obtained from the core monomer. The glass transition temperature of the shell polymer obtained from the shell monomer, in order to enhance shelf stability of a polymerized toner, is generally 50 to 120 degrees centigrade, preferably 60 to 110 degrees centigrade, more preferably 80 to 105 degrees centigrade. If the glass transition temperature of the shell polymer is too low, even when the glass transition temperature of the shell polymer is higher than that of the core polymer, there are some cases where shelf stability is reduced. The difference in glass transition temperature between the core polymer and the shell polymer is generally not less than 10 degrees centigrade, preferably not less than 20 degrees centigrade, more preferably not less than 30 degrees centigrade.

A shell monomer forming small liquid droplets having a number average particle size smaller than that of the core particle is preferable. If the particle size of the liquid droplet of the shell monomer is too large, shelf stability tends to be reduced.

A mixture of the shell monomer and the aqueous dispersion medium is microscopically dispersed by means such as supersonic wave emulsification equipment to obtain the liquid droplets of the shell monomer. After that, it is preferable that the droplets are added into the reaction system in the presence of the core particle.

Although the shell monomer is not especially limited to a particular water solubility at 20 degrees centigrade, a polymer particle having a good shelf stability can be obtained easily if a monomer having a water-solubility of not less than 0.1 percent by weight at 20 degrees centigrade is used, since the monomer having a high water solubility tend to move onto a core particle promptly.

On the other hand, if a monomer having a water solubility of less than 0.1 percent by weight at 20 degrees centigrade is used, the monomer tends to move onto a core particle slowly, when, as in the above, it is preferable that the suspension polymerization is carried out after making a suspension of liquid droplets. Also, even if a monomer having a water solubility of less than 0.1 percent by weight at 20 degrees centigrade is used, a polymer particle having a good shelf stability is readily obtained by adding an organic solvent having a water solubility of not less than 5 percent by weight at 20 degrees centigrade, since the shell monomer then moves onto the core particle promptly.

For the shell monomer, as the monomer having a water solubility of less than 0.1 percent by weight at 20 degrees centigrade, there can be mentioned styrene, butyl acrylate, 2-ethylhexyl acrylate, ethylene, propylene and the like. As the monomer having a water solubility of not less than 0.1 percent by weight at 20 degrees centigrade, there can be mentioned methacrylate or acrylate such as methyl methacrylate, methyl acrylate; vinyl cyanide such as acrylonitrile, methacrylonitrile; nitrogen-containing vinyl compounds such as 4-vinyl pyridine; vinyl acetate; and acrolein.

As the organic solvent preferably used when a monomer having a water solubility of less than 0.1 percent by weight at 20 degrees centigrade is used, there can be mentioned lower alcohols such as methanol, ethanol, isopropyl alcohol, n-propyl alcohol, butyl alcohol; ketones such as acetone, methyl ethyl ketone; cyclo ethers such as tetrahydrofuran, dioxane; ethers such as dimethyl ether, diethylether; amides such as dimethyl formamide. The amount of the organic solvent is the quantity for obtaining a solubility of not less than 0.1 percent by weight of the shell monomer in a dispersion medium which is a mixture of water and the organic solvent. Specifically, the amount of the organic solvent, depending on the nature or the amount of the organic solvent and the shell monomer, is generally 0.1 to 50 parts by weight, preferably 0.1 to 40 parts by weight, more preferably 0.1 to 30 parts by weight based on 100 parts by weight of the aqueous dispersion medium. Although the adding order of the organic solvent and the shell monomer is not especially limited, in order to obtain a polymer particle having a good shelf stability and to promote movement of the shell monomer onto the core particle, it is preferable that the shell monomer is added after the organic solvent addition.

If both the monomer having the water solubility of not less than 0.1 percent by weight and the monomer having the water solubility of less than 0.1 percent by weight are used, it is preferable that the monomer having the water solubility of not less than 0.1 percent by weight is added, and is polymerized, and then the organic solvent is added, the monomer having the water solubility of less than 0.1 percent by weight is added, and then is polymerized. By this adding method, the glass transition temperature of the polymer obtained by polymerizing the monomer in the presence of the core particle and the added amount of the monomer can be easily controlled to regulate the fixing temperature of the polymerized toner.

It is preferable to use an electric charge control agent included in the shell monomer. The electric charge control agent is used to enhance the chargeability of the toner. The electric charge control agent may have either a negative or a positive electric charge. As the electric charge control agent, there can be mentioned nigrosine NO1 (produced by Orient Chemical Co.), nigrosine EX (produced by Orient Chemical Co.), Aizen Spilon black TRH (produced by Hodogaya Chemical Co.), T-77 (produced by Hodogaya Chemical Co.), Bontron S-34 (produced by Orient Chemical Co.), and Bontron E-84 (produced by Orient Chemical co.). The amount of the electric charge control agent, based on 100 parts by weight of the monomer, is generally 0.01 to 10 parts by, weight, preferably 0.1 to 5 parts by weight.

As a specific method of suspension polymerization of the shell monomer in the presence of the core particle, there can be mentioned a method comprised of adding a shell monomer into a polymerization reaction system used for obtaining a core particle and polymerizing the shell monomer, or a method comprised of charging a core particle produced with another reaction system, adding a shell monomer thereto and polymerizing the shell monomer.

The shell monomer can be added into a reaction system in a lump, or continuously or intermittently with a pump such as plunger pump.

In the polymerized toner of the present invention, in order to obtain a polymer particle having a core-shell structure, it is preferable that the polymerization initiator represented by the formula 1 is added when the shell monomer is added. The present inventors believe that the polymerization initiator represented by the formula 1 enters into the surface or its vicinity of the core particle into which the shell monomer is moved, so the shell polymer tends to be formed on the surface of the core particle, if the polymerization initiator represented by the formula 1 is added when the shell monomer is added.

In the polymerized toner of the present invention, the proportion by weight of the core monomer and the shell monomer (core monomer/shell monomer) is generally 40/60 to 99.9/0.1.

If the proportion is too large, that is the amount of the shell monomer is too small, the effect of enhancing shelf stability is reduced. If the proportion is too small, that is the amount of the core monomer is too small, the reduction of fixing temperature or the effect of enhancing overhead projector transparency is lowered.

The polymerized toner of the present invention may be one provided with an outer additive on the surface of the polymer particle. As the outer additive, there can be mentioned inorganic particles, organic particles, preferably silica particles, titanic oxide particles, especially preferably hydrophobic silica particles. In order to bind the outer additive on the polymer particle, generally, the outer additive and the above polymer particles are charged in a mixer such as Henschel mixer and are stirred.

The polymerized toner of the present invention is comprised of the polymer particle, including a shell polymer obtained by polymerizing a shell monomer and a core particle, having a structure in which the shell polymer covers the core particle.

In the polymerized toner of the present invention, the volume average particle size of the core particle is generally 1 to 20 micrometer, preferably 2 to 10 micrometer. If the core particle is too large, resolution of an image is reduced. Also, the ratio of the volume average particle size (hereafter "dv") and the number average particle size (hereafter "dp"), that is dv/dp, is generally not more than 1.7, preferably not more than 1.5.

The average thickness of shell is generally 0.001 to 1 micrometer, preferably 0.005 to 0.5 micrometer. If the thickness is too large, fixability is reduced. If the thickness is too small, shelf stability is reduced.

The core particle size and the thickness of the shell of the polymerized toner, in case observation with an electron microscope is available, can be obtained by measuring directly the core particle size and the thickness of the shell of particles on the electron microscopic picture. In case observation with an electron microscope is unavailable, the core particle size and the thickness of the shell of the polymerized toner can be obtained by measuring the size of the core particle before polymerization of a shell monomer with an electron microscope or a Coulter counter, then measuring the size of the polymer particles with an electron microscope or a Coulter counter after polymerization of the shell monomer, and calculating the thickness of the shell from the difference in polymer particle size before and after polymerization of the shell monomer. In case the above method is unavailable, the core particle size and the thickness of the shell of the polymerized toner can be obtained by measuring the size of the core particles before polymerization of the shell monomer with an electron microscope or a coal-tar counter, then calculating the thickness of the shell from the amount of shell monomer and the core particle size.

The polymerized toner of the present invention has a toluene insolubility of generally not more than 50 percent by weight, preferably not more than 20 percent by weight, more preferably not more than 10 percent by weight. If toluene insolubility is too large, fixability is reduced. Toluene insolubility is obtained by pressure-molding a polymer forming a polymerized toner, placing the molded polymer in a cage made of an 80-mesh net, dipping the cage in toluene for 24 hours at room temperature, drying the residual solid in the cage, measuring the weight thereof, and calculating the toluene insolubility as the percentage of the solid based on the weight of the molded polymer.

The polymerized toner of the present invention has a ratio of long diameter (hereafter "rl") and short diameter (hereafter "rs"), that is rl/rs, being generally 1 to 1.2, preferably 1 to 1.1. if this ratio is too large, resolution of image is reduced and durability tends to be reduced, since toner particles undergo larger friction with each other and the outer additive falls off while the toner in the toner housing of a visible image forming apparatus.

With the polymerized toner of the present invention, the fixing temperature can be reduced to a low temperature of 80 to 180 degrees centigrade, preferably 100 to 150 degrees centigrade; moreover the toner particles do not aggregate in storage, and shelf stability is excellent. Also, since the amount of static charge of the toner is not reduced under conditions of high temperature and high humidity, fogging and reduction of printing density can be prevented.

The image forming apparatus of the present invention is comprised of a photosensitive material; means for charging a surface of the photosensitive material; means for recording an electrostatic latent image on the surface of the photosensitive material; means for storing the above polymerized toner; means for developing the electrostatic latent image on the surface of the photosensitive material with the toner to obtain a toner image; and means for transcribing the toner image from the surface of the photosensitive material onto a transcription sheet.

The image forming apparatus of the present invention is explained in detail based on an embodiment illustrated in the accompanying figure.

As illustrated in FIG. 1, an image forming apparatus of an embodiment of the present invention comprises a photosensitive drum 1, as a photosensitive material, which is revolvable along the direction of the arrow A. The photosensitive drum comprises a photoelectric conductive layer provided on the surface of a drum material having electric conductivity. The photoelectric conductive layer is made of organic photosensitive material, selenium photosensitive material, zinc oxide photosensitive material, amorphous silicone photosensitive material, and the like.

Around the photosensitive drum 1, along the circumferential direction thereof, a charge roll 3 as means for charging, a laser irradiation equipment 4 as means for recording, a developing roll 8 as means for developing, a transcribing roll 6 as means for transcribing, and a cleaning equipment are fixed.

The charge roll for charging the surface of the photosensitive drum positively or negatively is provided with voltage, and touches the surface of the photosensitive drum. Thus, the surface of the photosensitive drum can be uniformly charged. Charging means by corona discharge can be substituted for the charge roll.

The laser irradiation equipment 4 is one for irradiating rays of light corresponding to the image signal on the surface of the photosensitive drum which was uniformly charged and for forming a static image on the irradiated portion (in the case of reversal development) or non-irradiated portion (in the case of regular development). As the other recording means, there can be mentioned recording means comprised of an LED array and an optical instrument.

The developing roll 8 is one for adhering toner on the static image of the photosensitive drum 1. Bias voltage between the developing roll and the photosensitive drum is applied for toner to be adhered on the irradiated portion in the case of reversal development or on the non-irradiated portion in the case of regular development.

There is a supplying roll 12 next to the developing roll 8 in a casing 11 in which toner 10 is stocked.

The developing roll is in contact with the photosensitive drum, and revolves along the direction of the arrow B. The supplying roll is in contact with the developing roll, and revolves along the direction of the arrow C, and supplies the toner to the surface of the developing roll. To supply the toner smoothly, the supplying roll also is provided with voltage.

A developing blade 9, as means for regulating the thickness of the toner layer on the surface of the developing roll, is fixed on the surface of the developing roll between the contact point with the supplying roll and the contact point with the photosensitive drum. This developing blade is comprised of conductive rubber and stainless steel, and is provided with voltage of |200| to |600| Volt in order to impart an electric charge to the toner. Therefore it is preferable that resistivity of the blade is not more than $10^6$ ohm centimeter (Ωcm).

The above polymerized toner 10 is stocked in the casing 11. The polymerized toner 10 is comprised of the above polymer particles. The polymer particles of the present invention have a core-shell structure. Since the shell portion is formed by a polymer having a higher glass transition temperature, the tack of the surface of the toner is low and it is rare that the toner aggregates. Since the polymerized toner of the present invention has a narrow spread of particle size, the toner layer formed on the developing roll by the regulating means can become substantially a mono-layer, whereby reproducibility of an image is excellent.

The transcribing roll 6 is one for transcribing the toner image from the surface of the photosensitive drum onto a transcription sheet 7. As the transcription sheet, there can be mentioned paper, overhead projector sheet and so on. As the transcribing means, there can be mentioned the above transcribing roll, corona discharger, transcribing belt and so forth.

The toner image transcribed onto the sheet is fixed on the sheet by fixing means 2. The fixing means is generally comprised of heating means and pressing means. The toner image transcribed onto the sheet is melted by heating means and the melted toner is pressed by pressing means to fix the toner on the sheet.

In the image forming apparatus of the present invention, since the above polymerized toner is used, even if the heating temperature by heating means is low, the toner can be melted easily and be fixed flatly on the surface of the transcription sheet with only light pressure. Therefore the image forming apparatus of this invention is available for high speed printing or high speed duplication and has an excellent overhead projector transparency.

The cleaning equipment is for cleaning residual toner on the surface of the photosensitive drum after the transcribing step. For example, the cleaning equipment is comprised of a cleaning blade. This cleaning equipment is not always needed, if a system in which toner can be simultaneously developed and cleaned by a developing roll is adopted.

The invention will now be described specifically by the following examples that by no means limit the scope of the invention. In the examples parts or % are by weight unless otherwise specified.

The properties were determined by the following methods.

(1) Particle Size of Toner

The volume average particle size and number average particle size were measured with Coulter multi-sizer (produced by Coulter Electric Co.) under conditions of 100 micrometer of aperture, Isoton II as a medium, 10% as concentration, and 50,000 as the number of the measured particles. The spread of particle size was represented by the ratio (dv/dp) of volume average particle size and number average particle size.

(2) Thickness of Shell

The thickness of the shell can be measured by Coulter multi-sizer or an electron microscope if the thickness is large. In case of small thickness as in these examples, the thickness (x) was determined according to the following formula (D).

$$\pi(r+x)^3/\pi r^3=1+s/100\ \rho \quad \text{(A)}$$

$$(x+r)/r=(1+s/100\ \rho)^{1/3} \quad \text{(B)}$$

wherein r is the volume average radius(micrometer) of the core particle (measured with Coulter multi-sizer) before adding the shell monomer, x is the thickness(micrometer) of the shell, s is the number of parts of an added shell monomer based on 100 parts by weight of core monomer, and ρ is the density(g/cm$^3$) of the shell polymer, and is approximately 1 g/cm$^3$.

$$(x+r)/r=(1+s/100)^{1/3} \quad \text{(C)}$$

$$x=r(1+s/100)^{1/3}-r \quad \text{(D)}$$

(3) Resistivity of Toner

Resistivity of the toner was measured with a dielectric loss measuring instrument (TRS-10 trade name, produced by Andou Electric Co.) at a temperature of 30 degrees centigrade, and a frequency of 1 kHz.

(4) Fixing Temperature of Toner

Printing all over (i.e., to cover the entire surface of a sheet) was carried out with a non-magnetic one-component developing system printer having variable fixing roll temperature. The image density (ID0) of the sheet printed all over was measured with a reflecting image density measuring instrument (produced by Macbeth Co.). Adhesive tape (Scotch mending tape 810-3-18, produced by Sumitomo 3M Co.) was placed on the sheet printed all over, was pressed on the sheet at a certain pressure, and was peeled off at a uniform rate in parallel to the sheet. After that, the image density (ID1) of the sheet was measured with the reflecting image density measuring instrument. Fixability was determined by the following formula.

$$\text{Fixability (\%)}=(\text{ID1}/\text{ID0})\cdot 100$$

The correlation between the fixability and the fixing roll temperature was obtained. The fixing temperature was defined as a fixing roll temperature giving a fixability of 80%.

(5) Shelf Stability of Toner

The toner was placed into a box, the box was made airtight, and the box was sunk in a constant-temperature water bath of 55 degrees centigrade for a certain time. After that, the toner was taken out from the box and was placed on a 42-mesh sieve, keeping the aggregated toner structure from breaking. The sieve was vibrated with a REOSTAT powder measuring instrument (produced by Hosokawa Micron Co.) under a vibration intensity of 4.5 for 30 seconds. The weight of toner which did not pass through the sieve was measured. Aggregation (% by weight) of toner was determined from the weight of the toner which did not pass through and the total weight of toner used in this test. Shelf stability was evaluated by the following ratings.

A: aggregation of less than 5% by weight;

B: aggregation of less than 10% by weight and not less than 5% by weight;

C: aggregation of less than 50% by weight and not less than 10% by weight;

D: aggregation of not less than 50% by weight.

(6) OHP Transparency

An OHP sheet ('Transparency', produced by UCHIDA YOUKOU Co.) was printed with the above printer having a fixing roll temperature of 170 degrees centigrade. An image on the overhead projector sheet was projected with an Overhead Projector, and OHP transparency was evaluated by the following index.

A: transparent

B: semi-transparent

C: nontransparent (7) The Amount of Electric Charge of Toner

The amount of electric charge was measured under L/L conditions (temperature of 10 degrees centigrade, and humidity of 20% RH), or H/H conditions (temperature of 35 degrees centigrade, and humidity of 80% RH).

Toner was set in a 4-sheets/min printer under the above conditions. After one day, five sheets having a halftone printing pattern were printed. Toner on the developing roll was aspirated with an aspiration electric charge amount measuring instrument, and the amount of electric charge based on the weight of toner was determined from a correlation of electric charge and aspiration.

(8) Quality of Printing Image

Continuous printing was carried out with the above printer. Quality of the printing image was evaluated by the following index.

A: not less than ten thousand sheets having printing density of not less than 1.3, as measured with a reflecting image density measuring instrument (produced by Macbeth Co.), and fog on non-picture portion of not more than 10%, as measured with a white colorimetry measuring instrument, can be obtained.

B: not less than 5 thousand sheets having printing density of not less than 1.3, as measured with a reflecting image density measuring instrument, and fog on non-picture portion of not more than 10%, as measured with a white colorimetry measuring instrument, can be obtained.

C: less than 5 thousand sheets having printing density of not less than 1.3, as measured with a reflecting image density measuring instrument, and fog on non-picture portion of not more than 10%, as measured with a white colorimetry measuring instrument, can be obtained.

EXAMPLE 1

A monomer composition consisting of 78 parts of styrene and 22 parts of butyl acrylate (giving a copolymer having a calculated glass transition temperature of 50 degrees centigrade), 7 parts of carbon black ('Printex 150T' trade name; produced by Degussa AG), 1 part of charge control agent ('Aizen Spilon Black TRH' trade name, produced by HODOGAYA Chemical Co.), 0.3 part of divinylbenzene, and 0.5 part of poly-methacrylate macro-monomer ('AA6' trade name, glass transition temperature of 94 degrees centigrade, produced by TOA GOUSEI Chemical Industries Co., Ltd.) were dispersed in a ball mill at room temperature to obtain a core monomer mixture.

Meanwhile, 3 parts of methyl methacrylate (giving a polymer having a calculated glass transition temperature of 105 degrees centigrade), 100 parts of water and 0.01 part of charge control agent ('Bontron E-84' trade name, produced by Orient Industries Co., Ltd.) were dispersed finely with a supersonic emulsifier to give a shell monomer dispersion. The droplets of shell monomer had a 1.6 micrometer volume average particle size measured with a micro-trac particle size distribution measuring instrument at a droplet concentration of 3% in an aqueous solution of 1% sodium hexa-meta-phosphate.

On the other hand, into an aqueous solution obtained by dissolving 9.8 parts of magnesium chloride in 250 parts of ion exchanged water, an aqueous solution obtained by dissolving 6.9 parts of sodium hydroxide in 50 parts of ion exchanged water was slowly added to obtain a dispersion of magnesium hydroxide colloid, that is, a water-insoluble metal hydroxide colloid. The spread of the above colloid size was measured with a micro-trac particle size distribution measuring instrument under conditions of measured range of 0.12 to 704 micrometer, measured time of 30 seconds and using ion exchanged water as a medium. D50, that is the particle size at 50 percent of the cumulative number distribution of particle size was 0.38 micrometer. D90, that is the particle size at 90 percent of the cumulative number distribution of particle size was 0.82 micrometer.

To the above dispersion of magnesium hydroxide colloid, the above core monomer mixture was added, and was maintained at 20 to 30 degrees centigrade while stirring for 2 to 3 minutes at a low speed agitator. At the time primary droplets having a volume average droplet size of about 200 micrometer were formed, 4 parts of t-butyl peroxy-2-ethylhexanoate were added. The result mixture was further stirred at 12000 rpm by means of TK homo-mixer until secondary droplets of core monomer mixture having a volume average droplet size of about 5 micrometer were formed. The obtained aqueous dispersion of core monomer mixture was charged in a polymerization reactor with agitator, polymerization reaction was begun at a reactor temperature of 90 degrees centigrade. When the polymerization conversion was 95%, the whole of the above shell monomer and 1 part of 2,2'-azobis(2-methyl-N-(1,1-bis (hydroxymethyl)-2-hydroxyethyl)propionamide) was added while maintaining the reactor at the same temperature. After 3 hours, the polymerization reaction was stopped to obtain an aqueous dispersion of polymer particles having a core-shell structure.

The volume average particle size of the core of the particle was 6.3 micrometer, the ratio of volume average particle size (dv) to number average particle size (dp), that is dv/dp, was 1.22.

The volume average particle size of the polymer particles was 6.4 micrometer, the ratio of volume average particle size to number average particle size was 1.23, rl/rs was 1.1, and toluene insolubility was 3%.

The aqueous dispersion of polymer particles having core-shell structure was brought to a pH of not more than 4 by sulfuric acid, was washed at 25 degrees centigrade for 10 minutes, was dehydrated by filtration, was reslurried by adding 500 parts of ion exchanged water to rinse. And more several dehydration and rinse cycles were repeated. After the last dehydration, the dehydrated solid was placed in a dryer having 45 degrees centigrade temperature for 24 hours to obtain polymer particles.

To 100 parts of the above polymer particles having a core-shell structure, 0.3 part of colloidal silica ('R-202' Trade name, Degussa AG) was added and was mixed with a Henschel mixer to make a polymerized toner. The resistivity of the polymerized toner obtained by the above process was 11.3 (logΩ(cm). The fixing temperature of the polymerized toner was 130 degrees centigrade. The shelf stability of the toner was very satisfactory (evaluation=A). The amount of electric charge of the toner was −26 $\mu$c/g at a temperature of 10 degrees centigrade and humidity of 20% R.H., and was −24 $\mu$c/g at a temperature of 35 degrees centigrade and humidity of 80% R.H. In the other image evaluations, printing density was high, fog or patches were not found, and an image having excellent resolution could be obtained.

EXAMPLE 2

Polymer particles and a polymerized toner were made by the same procedures as described in Example 1 except that 2,2'-azobis(2-methyl-N-(1,1-bis(hydroxymethyl)-2-hydroxyethyl)propionamide) was replaced by 2,2'-azobis(2-methyl-N-(2-hydroxyethyl)-propionamide). The results are shown in Table 1. In image evaluation, printing density was high, fog or patches were not found, and an image having excellent resolution could be obtained.

EXAMPLE 3

Polymer particles and a polymerized toner were made by the same procedures as described in Example 1 except that the macro-monomer used in Example 1 was replaced by an other macro-monomer ("AA2", produced by TOA GOUSEI Chemical Industries Co., Ltd., glass transition temperature of approximately 90 degrees centigrade). The results are shown in Table 1.

EXAMPLE 4

Polymer particles and a polymerized toner were made by the same procedures as described in Example 1 except that the 3 parts of methylmethacrylate used as a shell monomer in Example 1 were replaced by 2.7 parts of methylmethacrylate and 0.3 part of butyl acrylate. The results are shown in Table 1.

EXAMPLE 5

Polymer particles and a polymerized toner were made by the same procedures as described in Example 1 except that the 3 parts of methylmethacrylate used as a shell monomer in Example 1 were replaced by 3 parts of styrene, and 20 parts of methanol were added before adding the shell monomer. The results are shown in Table 1.

TABLE 1

| | Example | | | | |
|---|---|---|---|---|---|
| | 1 | 2 | 3 | 4 | 5 |
| Core particle | | | | | |
| dv (μm) | 6.3 | 6.4 | 6.3 | 6.5 | 6.2 |
| dv/dp | 1.22 | 1.21 | 1.25 | 1.25 | 1.22 |
| polymer particle | | | | | |
| thickness of shell (μm) | 0.03 | 0.03 | 0.03 | 0.03 | 0.03 |
| toluene insolubility (%) | 3 | 4 | 3 | 5 | 4 |
| toner | | | | | |
| dv (μm) | 6.4 | 6.5 | 6.6 | 6.6 | 6.3 |
| dv/dp | 1.23 | 1.23 | 1.26 | 1.26 | 1.24 |
| resistivity (logΩcm) | 11.3 | 11.4 | 11.4 | 11.4 | 11.4 |
| fixing temp. (° C.) | 130 | 120 | 130 | 120 | 120 |
| shelf stability | A | A | A | A | A |
| charge amount (μc/g) | | | | | |
| under L/L | −26 | −25 | −28 | −25 | −27 |
| under H/H | −24 | −24 | −25 | −23 | −25 |
| image quality | A | A | A | A | A |

Comparative Example 1

Polymer particles and a polymerized toner were made by the same procedures as described in Example 1 except that 2,2'-azobis(2-methyl-N-(1,1-bis(hydroxymethyl)-2-hydroxyethyl)propionamide) was replaced by benzoyl peroxide. The results are shown in Table 2.

Comparative Example 2

Polymer particles and a polymerized toner were made by the same procedures as described in Example 1 except that 2,2-azobis(2-methyl-N-(1,1-bis(hydroxymethyl)-2-hydroxyethyl)propionamide) was replaced by ammonium persulfate. The results are shown in Table 2.

Comparative Example 3

Polymer particles and a polymerized toner were made by the same procedures as described in Example 1 except that 2,2'-azobis(2-methyl-N-(1,1-bis(hydroxymethyl)-2-hydroxyethyl)propionamide) was replaced by 2,2'-azobis-iso-butyro-nitrile. The results are shown in Table 2.

EXAMPLE 6

Polymer particles and a polymerized toner were made by the same procedures as described in Example 1 except that t-butylperoxy-2-ethylhexanoate used as a constituent of the core monomer mixture in Example 1 was replaced by 2,2-azobis-iso-butyro-nitrile and the reaction temperature was changed to 80 degrees centigrade. The results are shown in Table 2.

EXAMPLE 7

Polymer particles and a polymerized toner were made by the same procedures as described in Example 1 except that butyl acrylate used as the core monomer in Example 1 was replaced by 2-ethylhexylacrylate. The results are shown in Table 2.

EXAMPLE 8

Polymer particles and a polymerized toner were made by the same procedures as described in Example 1 except that 7 parts of carbon black were replaced by 5 parts of magenta pigment (Pigment Red 122). The results are shown in Table 3.

TABLE 2

| | Example | | Comparative Example | | |
|---|---|---|---|---|---|
| | 6 | 7 | 1 | 2 | 3 |
| Core particle | | | | | |
| dv (μm) | 6.4 | 6.5 | 6.3 | 6.5 | 6.5 |
| dv/dp | 1.24 | 1.23 | 1.25 | 1.26 | 1.24 |
| polymer particle | | | | | |
| thickness of shell (μm) | 0.03 | 0.03 | 0.03 | 0.03 | 0.03 |
| toluene insolubility 1 (%) | 3 | 3 | 5 | 4 | 4 |
| toner | | | | | |
| dv (μm) | 6.5 | 6.6 | 6.4 | 6.6 | 6.6 |
| dv/dp | 1.27 | 1.25 | 1.43 | 1.30 | 1.37 |
| resistivity (logΩcm) | 11.3 | 11.4 | 10.7 | 11.2 | 10.6 |
| fixing temp. (° C.) | 120 | 130 | 120 | 130 | 140 |
| shelf stability | A | A | D | C | D |
| charge amount (μc/g) | | | | | |
| under LL | −27 | −25 | −17 | −23 | −20 |
| under H/L | −24 | −23 | −13 | −16 | −12 |
| image quality | A | A | C | B | C |

Comparative Example 4

Polymer particles and a polymerized toner were made by the same procedures as described in Comparative Example 1 except that 7 parts of carbon black were replaced by 5 parts of magenta pigment (Pigment Red 122). The results are shown in Table 3.

Comparative Example 5

Polymer particles and a polymerized toner were made by the same procedures as described in Comparative Example 3 except that 7 parts of carbon black were replaced by 5 parts of magenta pigment (Pigment Red 122). The results are shown in Table 3.

EXAMPLE 9

Polymer particles and a polymerized toner were made by the same procedures as described in Example 1 except that 7 parts of carbon black were replaced by 5 parts of quinophthalone yellow pigment (Pigment Yellow 138). The results are shown in Table 3.

EXAMPLE 10

Polymer particles and a polymerized toner were made by the same procedures as described in Example 2 except that 7 parts of carbon black were replaced by 5 parts of cyan pigment (Pigment Blue 15:3). The results are shown in Table 3.

EXAMPLE 11

Polymer particles and a polymerized toner were made by the same procedures as described in Example 9 except that 2'-azobis(2-methyl-N-(1,1-bis(hydroxymethyl)-2-hydroxyethyl)propionamide) was replaced by 2,2'-azobis(2-methyl-N-(2-hydroxyethyl)-propionamide). The results are shown in Table 3. In image evaluation, printing density was high, fog or patches were not found, and an image having excellent resolution could be obtained.

The polymerized toner of the present invention has a lower fixing temperature, good overhead projector transparency and excellent shelf stability, and the amount of electric charge is not reduced under conditions of high humidity. This polymerized toner can be advantageously used for a high speed and high resolution printing image forming apparatus.

TABLE 3

| | Example | | | | Comparative Example | |
|---|---|---|---|---|---|---|
| | 8 | 9 | 10 | 11 | 4 | 5 |
| Core particle | | | | | | |
| dv (μm) | 6.3 | 6.4 | 6.5 | 6.2 | 6.4 | 6.7 |
| dv/dp | 1.22 | 1.24 | 1.18 | 1.25 | 1.24 | 1.25 |
| polymer particle | | | | | | |
| thickness of shell (μm) | 0.03 | 0.03 | 0.03 | 0.03 | 0.03 | 0.03 |
| toluene insolubility (%) | 3 | 4 | 4 | 5 | 4 | 4 |
| toner | | | | | | |
| dv (μm) | 6.4 | 6.5 | 6.6 | 6.3 | 6.5 | 6.8 |
| dv/dp | 1.24 | 1.25 | 1.20 | 1.26 | 1.43 | 1.27 |
| resistivity (logΩcm) | 11.8 | 11.7 | 11.5 | 11.9 | 10.5 | 10.3 |

TABLE 3-continued

| | Example | | | | Comparative Example | |
|---|---|---|---|---|---|---|
| | 8 | 9 | 10 | 11 | 4 | 5 |
| fixing temp. (° C.) | 120 | 120 | 130 | 120 | 130 | 130 |
| shelf stability | A | A | A | A | D | D |
| charge amount (μc/g) | | | | | | |
| under LL | −28 | −29 | −28 | −30 | −28 | −22 |
| under H/H | −26 | −27 | −26 | −27 | −15 | −15 |
| overhead projector | A | A | A | A | B | B |
| image quality | A | A | A | A | C | C |

We claim:

1. A method for producing a polymerized toner comprising polymer particles, which comprises the steps of suspension polymerizing a monomer for a core or a mixture of at least two monomers for a core to obtain core particles, and suspension polymerizing a monomer for a shell or a mixture of at least two monomers for a shell in a dispersion medium in the presence of the core particles dispersed in said dispersion medium and with the aid of a polymerization initiator added to said dispersion medium, wherein said monomer for a shell or mixture of monomers for a shell is one which gives upon polymerization a polymer having a glass transition temperature higher than that of the polymer forming the core particles, and said polymerization initiator is represented by the following formula 1:

(1)

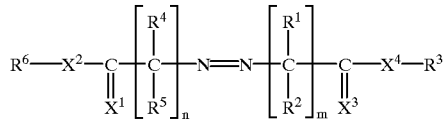

wherein $X^1$, $X^2$, $X^3$ and $X^4$ independently represent oxygen atom, sulfur atom, >NR, wherein R is hydrogen atom, alkyl group, or aryl group;

$R^1$, $R^2$, $R^3$, $R^4$, $R^5$ and $R^6$ independently represent alkyl group, aryl group, or alkyl or aryl group having at least one substituent which is —OR, —OH, —NHR, or —$NR_2$, wherein R is alkyl group or aryl group, and n and m independently represent an integer of 1 to 10.

2. The method according to claim 1, wherein the core particle is obtained by suspension polymerizing (1) a monomer for a core or mixture of monomers for a core which gives upon polymerization a polymer having a glass transition temperature of not more than 70° C., and (2) a macro-monomer.

3. The method according to claim 2, wherein the monomer for the core is a vinyl monomer.

4. The method according to claim 2, wherein the monomer for the core is a mixture of styrene and n-butyl acrylate, a mixture of styrene and 2-ethyl hexyl acrylate, or a mixture of styrene, n-butyl acrylate and 2-ethyl hexyl acrylate.

5. The method according to claim 1, wherein the core particle is obtained by suspension polymerizing (1) a monomer for a core or mixture of monomers for a core, (2) a macro-monomer, and (3) a crosslinkable monomer.

6. The method according to claim 5, wherein the macro-monomer has an acrylyl group or a methacrylyl group at the end of the molecular chain.

7. The polymerized according to claim 5, wherein the macro-monomer is a polymer or a copolymer of a methacrylate or an acrylate.

8. The method according to claim 1, wherein the suspension polymerization is carried out in the presence of a dispersant comprising a colloid of a water-insoluble metal hydroxide.

9. The method according to claim 8, wherein the dispersant comprises a colloid of a water-insoluble metal hydroxide, said colloid having a particle size at 50 percent of the cumulative number distribution of particle size (D50) of not more than 0.5 micrometer, and a particle size at 90 percent of the cumulative number distribution of particle size (D90) of not more than 1 micrometer.

10. The method according to claim 8, wherein the dispersant comprises a colloid of a water-insoluble metal hydroxide, said colloid being obtained by bringing to a value of not less than 7 the hydrogen ion exponent (pH) of an aqueous solution of a water-soluble multivalent metal compound.

11. The method according to claim 8, wherein the dispersant comprises a colloid of a water-insoluble metal hydroxide, said colloid being obtained by reacting a water-soluble multivalent metal compound with an alkali metal hydroxide in a water phase.

12. The method according to claim 1, wherein the suspension polymerization is carried out after making a suspension in water of liquid droplets of the monomer for a shell or mixture of monomers for a shell having a number average particle size smaller than that of the core particle.

13. The method according to claim 1, wherein the monomer for a shell or mixture of monomers for a shell has a water solubility of not less than 0.1 weight percent at 20 degrees centigrade.

14. The method according to claim 1, wherein the suspension polymerization is carried out by adding the monomer for the shell or mixture of monomers for a shell having a water solubility of less than 0.1 weight percent at 20 degrees centigrade and an organic solvent.

15. The method according to claim 1, wherein the suspension polymerization of the monomer for the shell or mixture of monomers for the shell is carried out in the presence of an electric charge control agent.

16. The method according to claim 1, wherein the core particle is obtained by suspension polymerizing the monomer for the core or mixture of monomers for the core, a macro-monomer, and a crosslinkable monomer, with an oil-soluble radical polymerization initiator.

17. The method according to claim 1, wherein the polymerization initiator is an oil-soluble organic peroxide having a molecular weight of not more than 250 and a temperature of a half-life period of 10 hours of 60 to 80° C.

18. The method toner according to claim 1, wherein the core particle is obtained by suspension polymerizing the monomer for the core or mixture of monomers for the core, a macro-monomer, and a crosslinkable monomer, in the presence of a colorant.

19. The method according to claim 1, wherein the polymerization initiator is represented by the formula 1 wherein $X^1$ and $X^3$ are oxygen;

$X^2$ and $X^4$ independently are >NR, wherein R is hydrogen atom, alkyl group, or aryl group;

$R^1$, $R^2$, $R^4$ and $R^5$ are methyl group;

$R^3$ and $R^6$ independently are alkyl group having at least one —OH substituent; and n and m independently are an integer of 1 to 3.

20. The method according to claim 1, wherein the polymerization initiator is represented the formula 1 is 2,2'-azobis(2-methyl-N-(1,1-bis(hydroxymethyl)-2-hydroxyethyl)propionamide) or 2,2'-azobis(2-methyl-N-(2-hydroxyethyl)-propionamide).

21. A method for producing a polymerized toner comprising polymer particles, which comprises the steps of:

suspension polymerizing a monomer for a core or a mixture of at least two monomers for a core to obtain core particles, and suspension polymerizing a monomer for a shell or a mixture of at least two monomers for a shell in a dispersion medium in the presence of the core particles dispersed in said dispersion medium and with the aid of a polymerization initiator added to said dispersion medium, wherein said monomer for a shell or mixture of monomers for a shell is one which gives upon polymerization a polymer having a glass transition temperature higher than that of the polymer forming the core particles, and said polymerization initiator is selected from a group consisting of azoamidine compounds, cyclo azoamidine compounds and azoamide compounds.

22. The method according to claim 21, in which said polymerization initiator is selected from a group consisting of 2,2'-azobis(2-methyl-N-phenylpropionamidine) dihydrochloride, 2,2'-azobis(N-(4-chlorophenyl)-2-methyl propionamidine) dihydrochloride, 2,2'-azobis(N-(4-hydroxyphenyl)-2-methyl propionamidine) dihydrochloride, 2,2'-azobis(2-methyl-N-phenylmethyl)-propionamidine) dihydrochloride, 2,2'-azobis(2-methyl-N-(2-propenyl) propionamidine)dihydrochloride, 2,2'-azobis (2-methylpropionamidine)dihydrochloride, 2,2'-azobis(N-(2-hydroxyethyl)-2-methyl propionamidine) dihydrochloride, 2,2'-azobis (2-(2-imidazoline-2-yl) propane, 2,2'-azobis(2-methyl-N-(1,1-bis(hydroxymethyl)-2-hydroxyethyl) propionamide), 2,2'-azobis(2-methyl-N-(1,1-bis(hydroxymethyl) ethyl) propionamide), 2,2'-azobis(2-methyl-N-(2-hydroxyethyl) propionamide), and 2,2'-azobis (2-methyl propionamide) dihydrate.

* * * * *